United States Patent [19]

Hudetz

[11] Patent Number: 4,988,124

[45] Date of Patent: Jan. 29, 1991

[54] PACKAGING BAG INSERT FOR FOLDED PUBLICATIONS

[75] Inventor: Michael L. Hudetz, Plano, Ill.

[73] Assignee: Solar Press, Inc., Naperville, Ill.

[21] Appl. No.: 422,094

[22] Filed: Oct. 16, 1989

[51] Int. Cl.[5] ..... G09F 3/00

[52] U.S. Cl. ..... 283/56; 281/15.1; 229/69; 282/11.5 R

[58] Field of Search ..... 283/56; 281/5, 2, 15.1; 229/69, 70, 72, 73; 282/11.5 A, 11.5 R

[56] References Cited

U.S. PATENT DOCUMENTS

| | | | |
|---|---|---|---|
| 3,275,316 | 9/1966 | Cleary | 283/56 |
| 3,369,732 | 2/1968 | Hanson | 281/3 R |
| 3,482,763 | 12/1969 | Carrigan | 229/69 |
| 3,582,111 | 6/1971 | Siiter | 283/56 |
| 3,608,816 | 9/1971 | Neubauer | 229/69 |
| 3,941,308 | 3/1976 | DiGirolomo et al. | 229/69 |
| 4,011,985 | 3/1977 | Simson | 283/56 |
| 4,346,916 | 8/1982 | Shelton | 282/11.5 A |
| 4,509,759 | 4/1985 | Small | 283/56 |
| 4,795,193 | 1/1989 | Schultz et al. | 281/15.1 |
| 4,844,329 | 7/1989 | Dicker | 282/11.5 A |

*Primary Examiner*—Paul A. Bell
*Assistant Examiner*—Hwei-Siu Payer
*Attorney, Agent, or Firm*—Emily A. Richeson

[57] ABSTRACT

A packaging bag is provided which is particularly adapted for insertion into a publication which is folded in its final form, the packaging bag comprising two sealed envelopes attached to each other along one margin of the envelopes and separated from each other by a fastening area.

3 Claims, 4 Drawing Sheets

(2-4)

PACKAGING BAG INSERT FOR FOLDED PUBLICATIONS

BACKGROUND OF THE INVENTION

The present invention relates generally to packaging bags for insertion into publications which are folded in their final form. More particularly, the present invention relates to packaging bags for insertion into publications having multiple pages, particularly wherein, in the publication's final form, the pages are fastened together by means such as saddle stitching.

A variety of different packages for conveying printed matter and/or product samples are known in the art. In one such package multiple objects such as printed items like brochures or reader service cards are enclosed together inside a skin or envelope, with the intended recipient's name and address applied to the outside. One such package or envelope may be made by folding a single, elongate sheet of material around the objects to be included so that the edges of the sheet approximate each other along the sheet's length. A seal is then formed between the edges by any or all of heat, pressure and/or adhesive, to obtain an elongate tube containing multiple, identical units of printed matter, product samples and/or some other object. The tube is sealed and severed between each of these units so that individual packages or envelopes are obtained, with each package or envelope containing a single unit of included material. The intended recipient's address may be preprinted on the inside or outside of the sheet or "wrapper," or on an insert inside the package so that the intended recipient's name and address are visible through a transparent portion of the wrapper. Alternatively, this information may be applied to the individual packages or envelopes after formation of the package or envelope is complete.

In the past these packages have been used extensively for direct mailing of product samples and product literature, such as "reader service" or response cards, to potential customers. However, these packages have not previously been used as inserts for folded publications, such as newspapers, catalogs and magazines, perhaps due to the difficulties presented if one were to attempt to secure such a package between a publication's pages.

One of the most common items used for insertion into publications is a card which is blown between the pages of a publication, either during or after the publication's assembly. However, although this type of insert has several advantages, blown-in cards have the disadvantage of not being secured in the publication, so that they readily fall out and become separated from the publication before it reaches its intended destination. Further, blown-in inserts rely on the force applied by the publication's pages for the insert to remain in place, and hence are inherently unsuitable for conveying materials such as packages of multiple cards or product samples which may be too heavy or bulky for the publication's pages to effectively retain in position.

Another insert, which may be more securely placed in a publication, is disclosed by U.S. Pat. No. 4,509,759. U.S. Pat. No. 4,509,759 discloses a game card for insertion between the pages of a folded publication, wherein the game card is printed on a larger portion of a card which is dimensioned such that a smaller portion of the card extends across the fold to the pages opposite those that the game card portion is situated between. Similar inserts, which may be used to convey product samples by laminating the samples to the larger portion of the card, are disclosed by U.S. Pat. No. 3,275,316. A similar card, which may have printed advertising thereon and may be folded to provide a return envelope, is disclosed by U.S. Pat. No. 4,011,985.

A package for conveying soap powder samples is disclosed by U.S. Pat. No. 4,433,783. This package is formed by sealing rectangular front and back panels together, with several ounces of soap powder spread in between. Additional seals are provided part of the way across the package to discourage the soap powder from shifting position substantially within the package, while permitting the passage of air from one portion of the package to another. Although this patent indicates such packages may be used as inserts for magazines or newspapers, no means of insertion into publications or means of securing such an insert within a publication is disclosed.

It is an object of the present invention to provide a packaging bag which is capable of containing printed matter and/or product samples.

It is also an object of the present invention to provide a packaging bag which is suitable for insertion into a publication which is folded in its final form.

It is an additional object of the invention to provide a packaging bag which may be readily secured within a folded publication wherein the pages are fastened together by saddle stitching.

It is a further object of the invention to provide a process for making a packaging bag which is particularly adapted for insertion into a publication which is folded in its final form.

These and additional and alternative objectives and advantages of the present invention will be readily apparent to those skilled in the art from the present invention as below shown in the drawings, and as described and claimed.

SUMMARY OF THE INVENTION

The present invention is directed to a packaging bag particularly adapted for insertion into a publication which is folded in its final form. This packaging bag comprises a plurality of sealed envelopes containing one or more inserts. These envelopes are attached to each other along at least one margin of the envelopes. At least two of the envelopes are separated by a fastening area such that at least one of the inserts in one of the envelopes is different from the inserts in an adjacent envelope.

The present invention also is directed to a packaging bag which consists essentially of two sealed, insert-containing envelopes attached to each other along one margin of the envelopes and being separated from each other by a fastening area.

The present invention includes a packaging bag which comprises a plurality of sealed envelopes which are attached to each other along at least one margin of said envelopes, and a fastening area. The fastening area is positioned between at least two of the envelopes and includes means for making the packaging bag bend preferentially at the fastening area.

Preferably, the portion of the packaging bag on one side of the fastening area is substantially equal in weight and dimensions to the portion on the other side of the fastening area.

It is also preferred that each envelope be separated by the adjacent envelope or envelopes by at least one seal, although at least two substantially parallel seals are more preferred. It is also preferred that the seal extend across the width of the envelope.

It is further preferred that the means for making the packaging bag bend preferentially at the fastening area include a score and/or a plurality of perforations in the fastening area. This score or these perforations preferably are located between two substantially parallel seals.

The present invention is also directed to a process for making a packaging bag which is particularly adapted for insertion into a publication which is folded in its final form. This process comprises the steps of placing insert material inside a tube; sealing said tube widthwise periodically along its length to form a plurality of compartments which are separated from each other by at least one seal; and cutting said tube widthwise periodically along its length so that said tube has two to four compartments between adjacent cuts.

Preferably the tube is formed by the steps of wrapping a continuous web of sheet stock around a form and said insert material so that two opposite edges of said stock approximate each other and said insert material is enclosed therein; and sealing said opposite edges together to form said tube. Alternatively, a seamless, tubular film may be formed by known means in the first instance, thereby reducing the number of seals for each compartment from three to two.

The seals preferably are formed by the application of pressure to the tube, and more preferably by the application of both heat and pressure.

Either tubular or sheet stock may be employed, having monolayer or multilayer construction. Stock selected from the group consisting of paper, cellophane, and thermoplastic films including those made from homopolymers and copolymers of olefins, such as polyethylene and polypropylene, linear low density polyethylene and very low density polyethylene, may be suitably employed as well as films made from polyesters and biodegradable plastics. The stock may be single layer or multilayer stock formed by well known lamination processes or coextrusion means. The stock may be coated with various agents to improve printability, sealability, or to control static electricity or other parameters. The stock may also be metallized. Many such films are commercially available and well known in the art. Examples of preferred stock include paper, polyethylene, polypropylene and a laminate of metallized polyester and polyethylene.

The present invention additionally is directed to a publication containing a packaging bag, comprising a plurality of pages folded and collated to form a multipage publication having a central fold, and a packaging bag which includes a plurality of sealed envelopes containing one or more inserts, the envelopes being attached to each other along at least one margin, such that at least two envelopes are separated by a fastening area. The packaging bag is inserted between pages of the publication such that the fastening area overlaps the central fold, and at least two of the envelopes are on opposite sides of the fold.

This publication preferably is stapled periodically along the fold, with staples preferably being placed on each side of the packaging bag fastening area, and more preferably at least one staple being stapled through the fold and the fastening area.

DETAILED DESCRIPTION OF THE INVENTION

A significant number of publications, such as many newspapers, catalogs and magazines, are produced by printing two pages of type, separated by a blank strip, on the front, back, or both front and back faces of a sheet or a web which is later cut into sheets. The printed sheet may then be collated with other similarly printed pages, and the sheets folded along the blank strip to create a multiple-paged publication wherein each of the above-described sheets forms two leaves. In some publications, such as many magazines and catalogs, but usually not newspapers, the sheets are fastened together in the area of the fold, such as by staples (currently referred to in the art as "saddle stitching") or some other similar device, to make the publication more durable during distribution and reading. Some publications, such as newspapers, may subsequently be folded one or more additional times to facilitate storage, mailing or other modes of distribution. For the purposes of the present application the "final form" of a publication is that form in which a publication ordinarily is used by a consumer.

Figure 1:
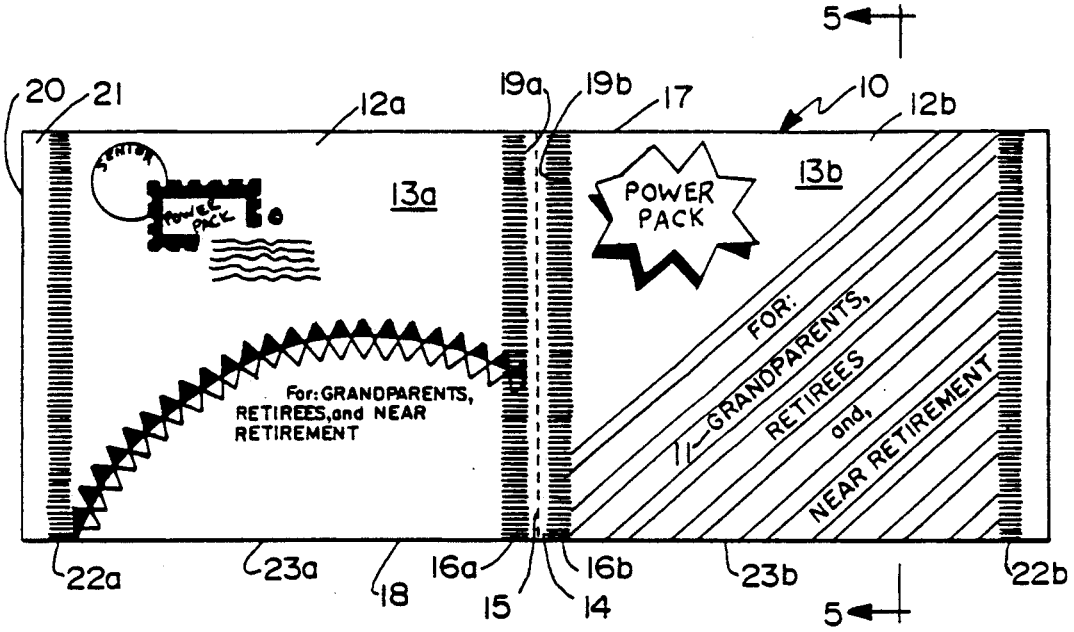
FIG. 1 is a front view of the preferred embodiment of the packaging bag of the invention.

Referring now to FIG. 1, the present invention is directed to a packaging bag 10 which is particularly suited for insertion into a publication which is folded in its final form. This packaging bag may have printed or embossed indicia 11 thereon. The bag 10 comprises a plurality of sealed envelopes, such as left envelope 12(*a*) and right envelope 12(*b*) having front surfaces 13(*a*) and 13(*b*), respectively. A fastening area is positioned between two envelopes, such as fastening area 14 positioned between envelopes 12(*a*) and 12(*b*). Fastening area 14 preferably contains a score and/or perforations 15, and is located between inner seals 16(*a*) and 16(*b*). The fastening area 14 and score and/or perforations 15 will beneficially extend in continuous fashion from packaging bag top edge 17 to bottom edge 18 to provide an area adapted for positioning and securing the bag within the folded area of a publication, and to provide means for easy separation and removal of the envelopes 12(*a*) and 12(*b*) by a reader.

Each of the envelopes 12(*a*), (*b*) is attached to another envelope along at least one margin, such as margins 19(*a*), (*b*) in FIG. 1. The envelopes may be attached either directly (such as envelopes 46(*a*) and (*b*) in FIG. 6 which share horizontal inner seal 47) or by being affixed to some intermediate means, as shown in FIG. 1 with envelopes 12(*a*), (*b*) being attached to each other through seals 16(*a*), (*b*) and fastening area 14. Although the envelopes may be separately formed and subsequently fastened together by conventional chemical or mechanical means using e.g. adhesives, stitching or staples, it is preferred that both envelopes be formed from unified, integral pieces of material, such as a tube or two overlapping pieces of stock or a single folded sheet of stock, so that no separate attachment means is required to connect adjacent envelopes.

Each envelope is adapted to hold one or more inserts (not shown). The packaging bag 10 is preferably formed of a film or material which is tubular in shape. Left envelope 12(*a*) is formed from this tube with top surface 13(*a*) having a top edge 17 connecting left edge 20 of left margin 21 to bottom edge 18 which in turn is connected to top edge 17 by right margin 19(*a*). The tube forms an envelope adapted for holding inserts by having substantially parallel, spaced apart left inner seal 16(*a*) and left outer seal 22(*a*). Seal 16(*a*) is adjacent to right margin 19(*a*) and extends from top edge 17 to bottom edge 18. Seal 22(*a*) is adjacent left margin 21 and also extends from top edge 17 to bottom edge 18 but is spaced apart from seal 16(*a*) to form envelope 12(*a*) for holding inserts.

Seals 16(*a*) and 22(*a*) may be continuous or intermittent, and these seals may be narrow or wide or of varying width. The seals may be formed by use of mechanical fasteners such as staples, or by an adhesive, or by pressing together a self-adhering inner surface of the envelope, or by fusion bonding the envelope's inner surface by applying heat and pressure. It will be recognized that the sealing parameters need only be sufficient to retain the inserts within the envelope until removal is desired, such as by a reader or customer. Similarly opposing adjacent envelope 12(*b*) is formed by right inner seal 16(*b*) and right outer seal 22(*b*) connecting top edge 17 to bottom edge 18.

At least two envelopes, separated by a fastening area, are required by the invention.

It is further preferred that the weight of the portion of the packaging bag, including inserts, on one side of the fastening area, such as in FIG. 1 envelope 12(*a*) to the left of fastening area 14, be substantially the same as the weight of the portion, including inserts, on the other side of the fastening area, such as 12(*b*) to the right of fastening area 14, in order to facilitate handling and proper alignment of the packaging bag when the packaging bag is incorporated into a publication, such as during collating. However, consistent with the preferred embodiment, some slight deviation, preferably about 10% or less, based on the total weight of the packaging bag, may be present.

Figure 3:
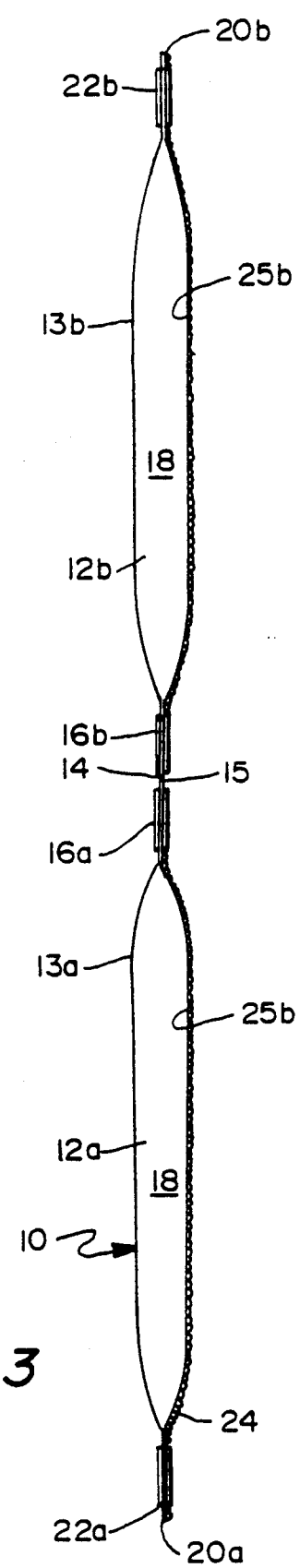
FIG. 3 is a bottom view of the embodiment of FIG. 1.

Referring to FIG. 3, a back view of the embodiment of FIG. 1 is presented where the packaging bag 10 is formed according to the preferred embodiment of the process of the invention such that the bag is formed from a single piece of sheet material. The sheet material is folded at top edge 17 and bottom edge 18 to produce a tube or enclosure, having a continuous periphery, by means of a longitudinal or "fin" seal 24 which connects opposing side portions of the sheet. Fin seal 24 typically runs the length of the packaging bag. Although this seal may be positioned at the top, bottom, front or back of the bag or at any place in between, consistent with the invention, it is preferred that the fin seal be on the back of the bag, as shown at 24 in FIG. 3, to reduce stress on the seal by packaged inserts having edges positioned at the top or bottom of the bag, and to allow an aesthetically pleasing display of information on the front. Envelopes 12(*a*), (*b*) are formed by connecting back sheet portions 25(*a*) and (*b*) of the front sheet portion (see 13(*a*), (*b*) in FIG. 1) by sealing. Seals 16(*a*) and 22(*a*) connect top edge 17 to bottom edge 18 to form envelope 12(*a*) and seals 16(*b*) and 22(*b*) similarly connect top edge 17 and bottom edge 18 to form opposing envelope 12(*b*) which adjoins envelope 12(*a*) along fastening area 14 and a score and/or perforations 15 extending from top edge 17 to bottom edge 18. Unlike seals 16(*a*), (*b*) and 22(*a*), (*b*), fin seal 24 does not seal back sheet portions 25(*a*) and 25(*b*) to the front sheet portion 13 (see FIG. 1). Instead, fin seal 24 connects back sheet portion 25(*a*) to back sheet portion 25(*b*) by aligning edges 26 of each portion 25(*a*) and 25(*b*) and sealing the inner surfaces of the sheet material together. Either or both of the back sheet portions 25(*a*) and 25(*b*) may have indicia 11 printed thereon.

Figure 5:
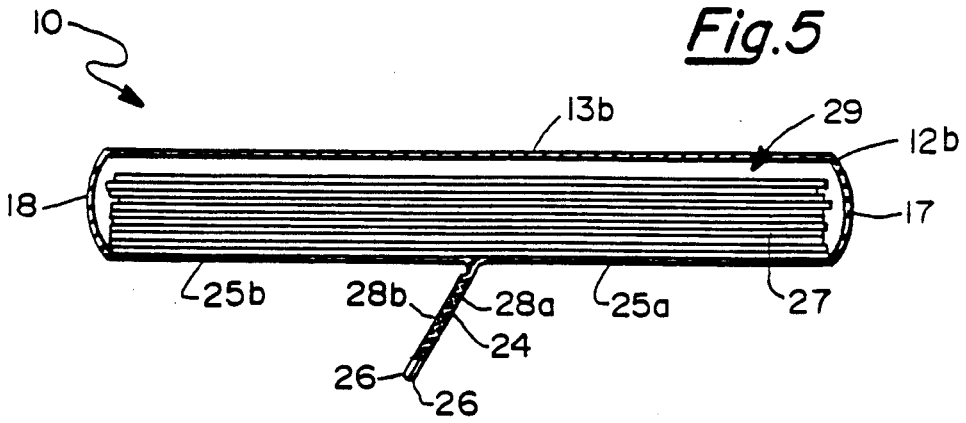
FIG. 5 is a cross-sectional view of the embodiment of FIG. 1, taken along dotted line 5—5 in FIG. 1.

In contrast to some envelopes known in the art which are empty and unsealed when incorporated into a publication and are intended to be torn out by the consumer and have the consumer insert material therein, the present invention contemplates that the packaging bag will be sealed to the outside so that an insert material is already contained within the bag when the bag is inserted in a publication, such as inserts 27 in envelope 12(*b*) as shown in FIG. 5. The particular type of insert material enclosed within the bag is not critical to the invention, but may be product samples such as, for example, cologne, detergent, cosmetics or personal care products, or may be written material such as product literature, reader service return post cards, return envelopes, photographs, or other pictorial materials or any combination thereof. Further, although an envelope may contain a single insert, such as a brochure or vial, a plurality of inserts may be enclosed within the same envelope, such as a product sample and related product literature or a stack of return post cards to use in requesting information regarding different products. At least one of the inserts in one of the envelopes is different from the inserts in an adjacent envelope. It is preferred that all of the inserts in the envelopes on one side of the fastening area be different from the inserts in the envelopes on the other side of the fastening area. It is further preferred that all of the inserts in each of the envelopes be different from the inserts in the adjacent envelope or envelopes, so that the packaging bag may be used to convey a wider variety of inserts.

A fundamental aspect of the present invention is that the packaging bag is sealed before insertion of the bag into a publication, so that materials, for example printed matter and product samples, are already present in the bag envelopes prior to assembly of the publication and therefore can not readily be introduced into the bag once formation of the packaging bag is complete. Thus the present invention permits insertion of filled packaging bags into saddle stitched publications whereby the bags may comprise envelopes having a thickness up to $\frac{1}{4}$ inch or greater and a weight of up to 30 grams or greater. Preferably the bag, including inserts, will have a thickness of at least 1/32 inch, and more preferably 1/16 inch, even more preferably $\frac{1}{8}$ inch and most preferably at least 3/16 inch. The thicker the insert-containing bag, the more inserts or the larger the insert one is able to attach to a publication. However, increasing thickness and/or weight may present problems in assembly of the bag-containing publication and/or problems in preventing premature separation of bag envelopes from the attached publication during shipping and/or handling e.g. by weight induced tearing along the fastening area. Smaller thicknesses will provide greater publication page contact on opposing sides of a bag envelope while inserted within a publication, which is believed to increase the frictional contact between pages near the bag envelope outer edges thus helping to prevent or reduce twisting motion along the fastening area which may contribute to premature separation.

Figure 2:
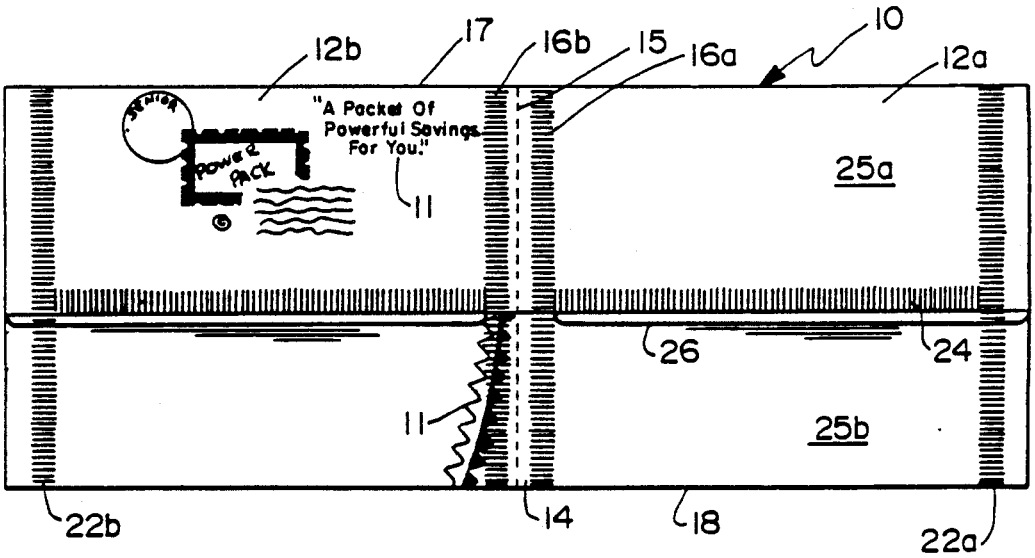
FIG. 2 is a back view of the embodiment of FIG. 1.
Figure 7:
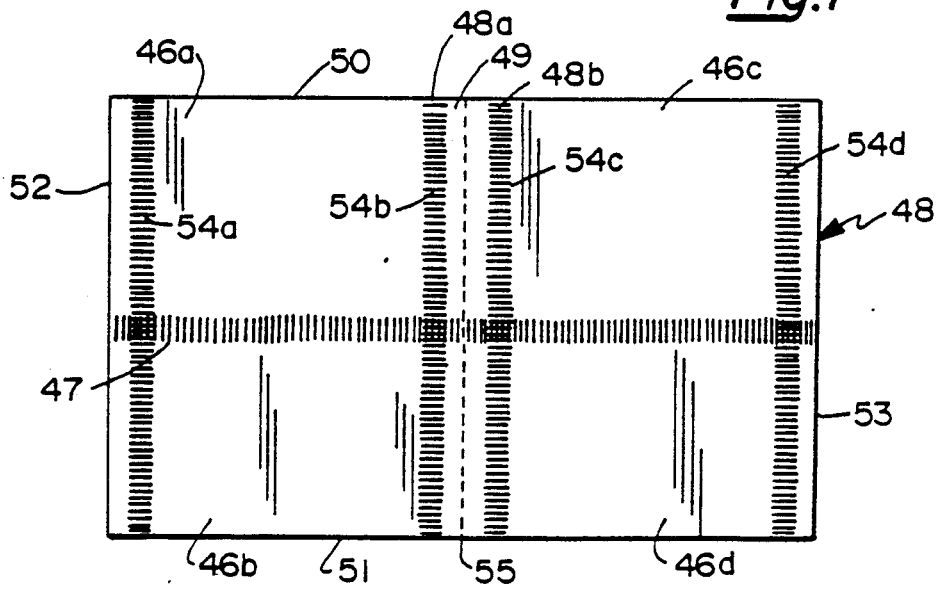
FIG. 7 is a front view of an alternative embodiment of the packaging bag of the invention.

It is preferred that each of the envelopes be separated from each adjacent envelope by at least one seal so as to discourage or prevent the contents of an envelope from substantially shifting position and from mixing with the contents of another envelope. Referring to FIG. 2, envelope 12(*b*) may be sealed from envelope 12(*a*) by means of one or both of inner seals 16(*b*) and 16(*a*). Referring to FIG. 7, the contents of envelope 46(*a*) may be sealed from envelope 46(*c*) by means of vertical inner seal 54(*b*) and/or 54(*c*), and from envelope 46(*b*) by means of horizontal inner seal 47. In the embodiment which is most preferred, each envelope is separated from each adjacent envelope by at least two (and more preferably only two) substantially parallel seals, such as parallel seals 16(*a*), (*b*) separating envelopes 12(*a*), (*b*) in FIG. 2. This is especially preferred for opposing envelopes connected by a fastening area 14 which is adapted for attachment to a publication. Inner seals, such as 16(*a*), (*b*), which span the entire width of the envelope are preferred.

Referring now to FIG. 3 which is a bottom view of the embodiment of FIG. 1, packaging bag 10 having opposing edges 20(*a*) and 20(*b*) is depicted with envelopes 12(*a*), (*b*). The envelopes 12(*a*), (*b*) are defined by front surfaces 13(*a*), (*b*) which extend around bottom edge 18 to form rear surface 25(*b*), which in turn is sealed to rear surface 25(*a*) (see FIG. 2) by fin seal 24, and are further defined by seals 22(*a*) and 16(*a*) (for envelope 12(*a*)) and seals 22(*b*) and 16(*b*) (for envelope 12(*b*)). Seals 16(*a*) and 16(*b*) are connected by fastening area 14 which has a score and/or perforations 15 located in the middle thereof.

According to the invention, the fastening area 14 is positioned between at least two envelopes, such as between envelopes 12(*a*), (*b*) in FIG. 3. Although the fastening area may be reinforced in comparison to other parts of the bag, such as by lamination to an additional layer of plastic sheeting, it is contemplated that the inserts will not be contained within the fastening area. Ordinarily, this results in the packaging bag being less thick and less rigid in the fastening area than in the area of the insert-containing envelopes. The fastening area should be sufficiently thin and flexible so that the packaging bag may be readily slipped between the sheets forming a multi-paged publication, with the fastening area at least partially overlapping the area which will become the publication's central fold.

Figure 4:
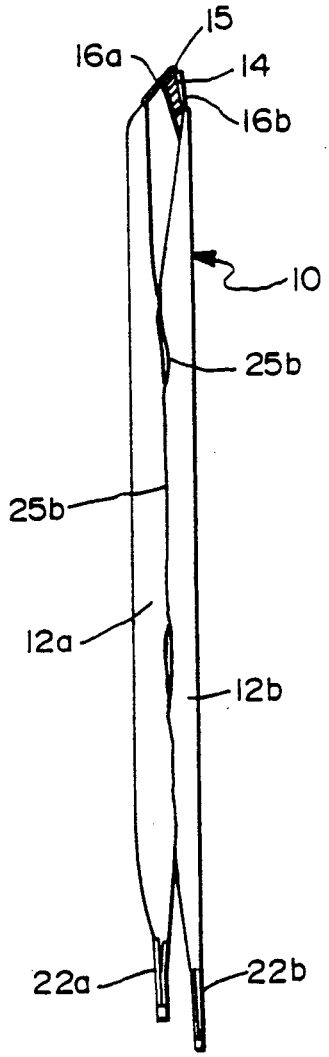
FIG. 4 is a bottom view of the embodiment of FIG. 1.

It is further preferred that the fastening area include a means for making the packaging bag bend or "break" preferentially at the fastening area in contrast to other parts of the packaging bag regardless of the presence or absence of inserts. For example, when the packaging bag is formed from a laminated material, one layer of material may be thinner or missing in the region of the fastening area, so that the bag in the fastening area is thinner and more flexible. Additionally or alternatively, such means may be introduced during or after assembly of the bag, such as by scoring and/or perforating the bag in the fastening area, such as perforations 15 in FIG. 1. Means such as scoring and/or perforations are preferred, as these may be used to make the fastening area bend or "break" preferentially in a very localized area, thereby permitting a more exact positioning of the packaging bag during insertion of the bag into a publication. Illustratively, FIG. 4 shows packaging bag 10 folded along fastening area 14 so that envelope 12(*b*) is along side envelope 12(*a*) so that surface 25(*b*) of envelope 12(*a*) is next to or touching surface 25(*b*) of envelope 12(*b*). Fastening area 14 between seals 16(*a*) and 16(*b*) is most severely bent along perforations 15. It is further preferred, in the embodiment wherein at least two of the envelopes are separated by a plurality of substantially parallel seals, that the scoring or perforations be located between (preferably midway) and substantially parallel to the seals, such as perforations 15 between seals 16(*a*) and 16(*b*) in FIGS. 1–4.

Referring now to FIG. 5, a cross-sectional view is presented taken along line 5—5 of FIG. 1 of packaging bag 10. Envelope 12(*b*) of bag 10 has a generally tubular shape formed by front surface 13(*b*) which extends at opposing ends 17 and 18 into respective back sheet portions 25(*a*) and 25(*b*). A margin area 28(*a*) and 28(*b*) of respective back sheet portions 25(*a*) and 25(*b*) terminates in aligned edges 26. Margin portions 28(*a*), (*b*) are bonded together to form fin seal 24. Envelope 12(*b*) defines an interior space 29 which contains a plurality of inserts 27 such as printed cards.

Figure 6:
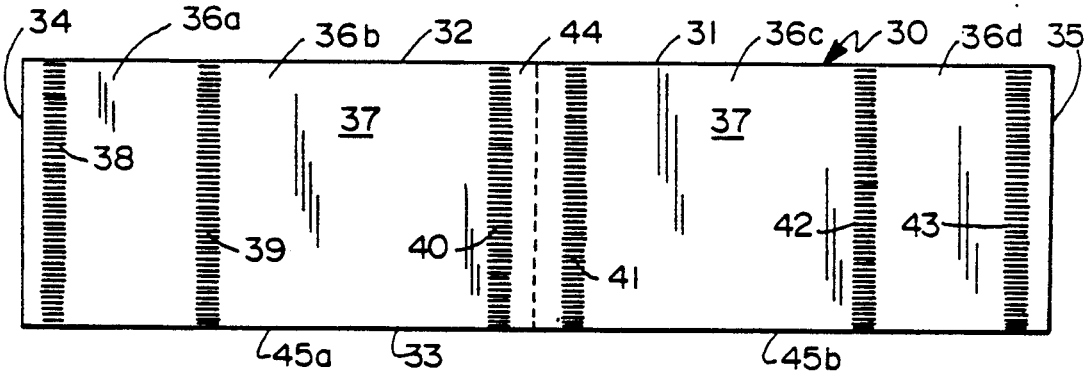
FIG. 6 is a front view of an alternative embodiment of the packaging bag of the invention.

In certain embodiments more than two envelopes may be included. Referring now to FIG. 6, a front view is depicted of an alternative packaging bag 30 which has a continuous peripheral edge 31 formed by connecting top edge 32 and parallelly displaced bottom edge 33 with spaced apart parallel left edge 34 and right edge 35 to form a rectangular bag 30 having several compartments or envelopes 36(*a*), (*b*), (*c*) and (*d*) attached together. Envelopes 36(*a*), (*b*), (*c*) and (*d*) are all formed by sealing a front surface 37 of the bag 30 to a rear surface (not shown) of the bag 30. These seals for each of envelopes 36(*a*), (*b*), (*c*) and (*d*) extend from the top edge 32 to the bottom edge 33. Envelope 36(*a*) is defined by seals 38 and 39, envelope 36(*b*) by seals 39 and 40, envelope 36(*c*) by seals 41 and 42, and envelope 36(*d*) by seals 42 and 43. Thus envelopes 36(*a*), (*b*), (*c*) and (*d*) are attached together in a linear fashion with fastening area 44 between envelopes 36(*b*) and 36(*c*).

More envelopes are shown in the alternative embodiment depicted in FIG. 7 wherein packaging bag 48 has envelopes 46(*a*), (*b*), (*c*) and (*d*) which are attached together in a matrix fashion with fastening area 49 spanning the area between envelopes 46(*a*) and 46(*c*), and 46(*b*) and 46(*d*), respectively. However, a packaging bag which has only two envelopes, such as 12(*a*), (*b*) in FIG. 1, is preferred. Bag 48 of FIG. 7 has a top edge 50 and bottom edge 51 connected by opposing left and right side edges 52 and 53, respectively. Four parallel vertical seals 54(*a*), (*b*), (*c*), and (*d*) cross horizontal inner seal 47 to defined envelopes 46(*a*), (*b*), (*c*), and (*d*). Fastening area 49 is bisected by perforations 55.

Referring again to FIG. 6, it should be clear that although the individual envelopes such as 36(*a*) and 36(*b*) of packaging bag 30 need not be of the same dimensions, it is preferred that the overall length and width of the portion of the packaging bag on one side of the fastening area 44 such as left portion 45(*a*) in FIG. 6 (or 23(*a*) in FIG. 1) be of substantially the same length and width as the corresponding portion on the other side of the fastening area such as right portion 45(*b*) in FIG. 6 (or 23(*b*) in FIG. 1). Preferably, however, this deviation should be about 2% or less, and more preferably about 1% or less. Packaging bags such as 10 in FIG. 1 and 48 in FIG. 7 wherein the envelopes are all of substantially the same dimensions are preferred.

Figure 8:
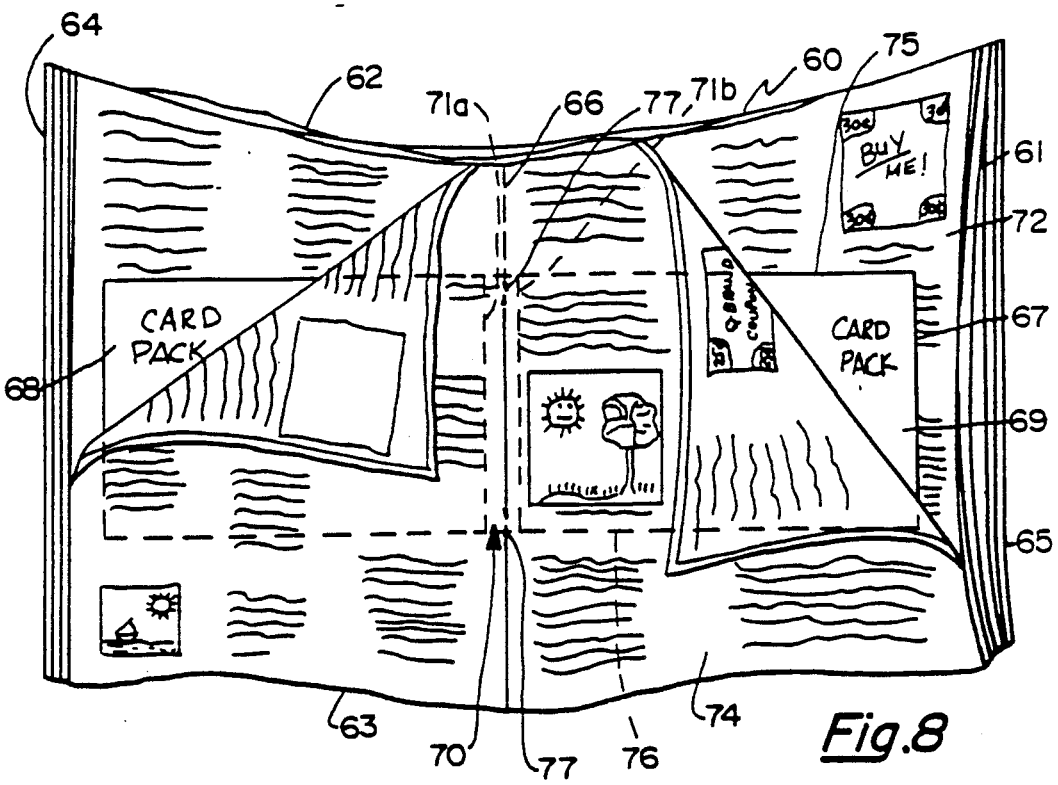
FIG. 8 is a front plan view of an embodiment of the publication of the invention, showing the preferred embodiment of the packaging bag of the invention inserted between the pages.

The present invention is also directed to a publication containing a packaging bag. Referring to FIG. 8, publication 60 comprises a plurality of sheets 61 having a top edge 62 and bottom edge 63 connected by spaced apart vertical side edges 64, 65. The sheets 61 are collated and folded to form a multi-page publication 60 having a central fold 66. Packaging bag 67 includes a plurality of sealed envelopes 68, 69 containing, one or more inserts (not shown). Envelopes 68, 69 are attached to each other along at least one margin of the envelopes, as described with respect to the packaging bag of the invention, above. At least two of the envelopes are separated by a fastening area 70, defined by vertical dashed lines 71(*a*) and 71(*b*). Packaging bag 67 is inserted between pages 72 and 73 (or, alternatively, on top of top sheet 74). The packaging bag need not be aligned so that the fastening area edges (such as 71(*a*), (*b*)) are parallel with the fold or so that the fold transects the fastening area, although this is preferred. However, bag 67 is inserted in publication 60 so that fastening area 70 of bag 67 overlaps central fold 66 and so that envelopes 68 and 69 are on opposite sides of fold 66.

In the preferred embodiment, the packaging bag is secured between the pages of the publication by means of at least two staples stapled through the central fold. These staples may securely hold the bag in the publication by either a press fit across the fastening area by the stapled together publication pages, with one staple being above the packaging bag's upper edge 75 and the other staple being below the bag's lower edge depicted by horizontal dashed line 76. Alternatively or additionally, the packaging bag may be secured between the pages of the publication by means of at least one staple which extends through the fastening area 70 of the packaging bag and at least one sheet of the publication at the central fold 66, such as staples 77 in FIG. 8.

The present invention is also directed to a process for making a packaging bag which is particularly adapted for incorporation into a publication which is folded in its final form. Although tubular stock, such as seamless tubular film, may be employed in the process of the invention, it is preferred that sheet or "flat" stock be used. According to the preferred process, a continuous web of sheet or "flat" stock, such as may be provided by a roll of paper or some other material, is fed into an apparatus such as a "horizontal bagger" or horizontal packaging machine such that the sheet is progressively wrapped around a form or "forming block" so that two opposite edges of the sheet approximate or touch each other. When the stock is very long and relatively narrow, such as when the stock is fed to the process from a large roll of material, these edges will usually be the side or lengthwise edges of the stock, as opposed to the endwise or widthwise edges.

The insert material to be included in one envelope is brought into proximity with the sheet, such as by conveyance by advancing pins to the under part of the forming block. As the sheet is folded around the form and the edges brought together the insert is enclosed within the sheet. The edges of the sheet are fitted into a slot, which serves to hold both the edges together and the insert material in position within the sheet. One or more rollers, which preferably are heated, then contact the edges to apply pressure and preferably also heat. The edges are thereby sealed together such that the sheet forms an elongate tube with the insert material contained therein. This tube may be maintained in a cylindrical shape, but preferably is substantially collapsed so as to be relatively flat.

Regardless of whether tubular stock is used or a tube is formed by the preferred steps described above, the tube is then sealed at predetermined intervals along its length in a direction approximately perpendicular to the tube's longitudinal axis so as to form a plurality of compartments or envelopes which are separated from each other by at least one seal. In the embodiment which is preferred, two substantially parallel seals, separated by a relatively narrow, unsealed area, are made between each compartment or envelope.

Formation of the tube, incorporation of insert material, and sealing the tube to form compartments or envelopes may be accomplished using means known in the art, such as, for example, "horizontal baggers" or horizontal packaging machines. Specific machines for performing these steps are known in art and are available from commercial sources.

The tube is cut widthwise periodically along its length to form a packaging bag. Although tubes wherein the compartments are separated by only one seal may be severed in the area of the seal so that one seal is cut to seal the ends of two separate envelopes, in the preferred embodiment wherein the envelopes are separated by two substantially parallel seals the cut preferably is made between the seals.

The cut will be made so that at least two envelopes are between successive cuts. Where more than two envelopes are between successive cuts, when the envelopes are of substantially equal size or envelopes of unequal size are made in pairs it is preferred that successive cuts be made between an even number of envelopes. It is further preferred that the number of envelopes between cuts be no more than two, with two envelopes being most preferred.

Consistent with the invention, means for making the packaging bag's seals are known in the art. For example, seals may be made by the application of pressure, heat or adhesive, or any combination thereof. The simultaneous application of both heat and pressure are preferred, particularly when the packaging bag is being made from a material which includes a plastic, such as laminates having a layer of polyethylene or polypropylene, wherein the plastic layer forms a heat sealing layer on the inside of the tube.

Figure 9:
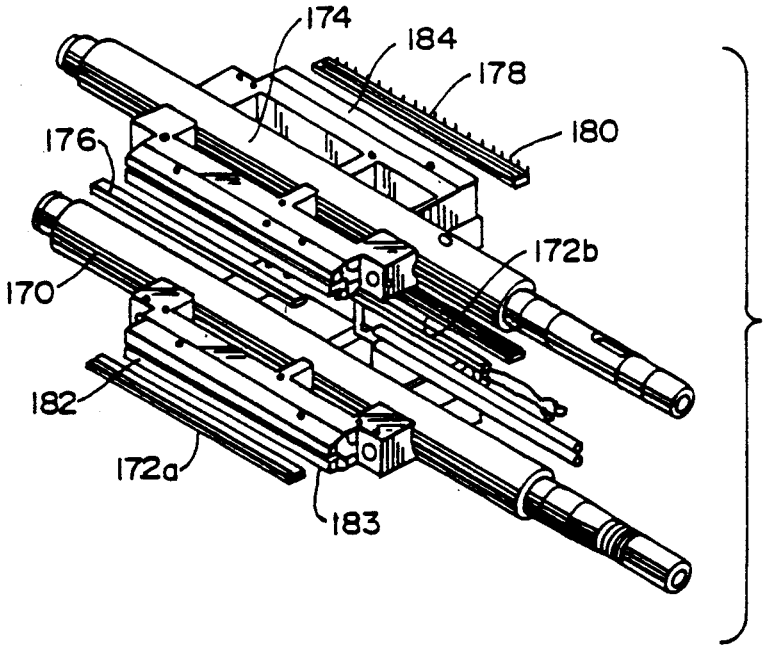
FIG. 9 is an exploded view of a machine useful in the preferred embodiment of the process of the invention.

In the preferred embodiment wherein the envelopes are separated by two parallel seals and a packaging bag is formed which has two envelopes separated by two seals on either side of an approximately parallel row of perforations, widthwise sealing and severing of the tube preferably is accomplished by feeding the tube through the machine shown in an exploded form in FIG. 9. This machine is readily available from commercial sources, or may be made by modifying commercially available equipment using known techniques.

Referring to FIG. 9, the tube (not shown) is feed between rotating anvil roller 170 bearing anvil bars 172(*a*), (*b*) and rotating cutting/perforating roller 174 bearing cutting blade 176 and perforating blade 178 bearing perforating teeth 180. The tube is sealed widthwise along its length by contacting the tube simultaneously with sealing surfaces 182 of sealer 183 attached to anvil roller 170 and the surface of corresponding sealing surfaces of sealer 184 attached to cutting/perforating roller 174. In the same step the tube is alternately cut by contacting the tube with cutting blade 176 and compressing the tube against anvil bar 172(*b*) and perforated by contacting the tube with perforating blade 178 and compressing the tube against anvil bar 172(*a*).

A variety of materials may be used to form the packaging bag, consistent with the invention, and many suitable materials are available from commercial sources. Either tubular or sheet stock may be employed, having monolayer or multilayer construction. Stock selected from the group consisting of paper, cellophane, and thermoplastic films including those made from homopolymers and copolymers of olefins, such as polyethylene and polypropylene, linear low density polyethylene and very low density polyethylene, may be suitably employed as well as films made from polyesters and biodegradable plastics. The stock may be single layer or multilayer stock formed by well known lamination processes or coextrusion means. The stock may be coated with various agents to improve printability, sealability, or to control static electricity or other parameters. The stock may also be metallized. Many such films are commercially available and well known in the art. Examples of preferred stock include paper, polyethylene, polypropylene and a laminate of metallized polyester and polyethylene.

Further modification of the packaging bag, process and publication of the invention described herein will be apparent to those of ordinary skill in the art, and all such modifications and changes are deemed within the scope of the invention as defined by the following claims.

I claim:

1. A publication containing a packaging bag comprising (a) a plurality of pages folded and collated to form a multi-page publication having a central fold, and (b) a packaging bag which includes a plurality of sealed envelopes containing one or more inserts and being attached to each other along at least one margin of said envelopes, at least two of said envelopes being separated by a fastening area, said packaging bag being inserted between pages of said publication such that said fastening area overlaps said central fold and at least two of said envelopes are on opposite sides of said fold.

2. The publication of claim 1 wherein said packaging bag is secured between the pages of said publication by means of at least two staples stapled through said central fold, wherein at least one staple is on each side of said fastening area.

3. The publication of claim 1 wherein said packaging bag is secured between the pages of said publication by means of at least one staple which is stapled through said fastening area and said central fold.

* * * * *